US005397670A

United States Patent [19]

Tong et al.

[11] Patent Number: 5,397,670

[45] Date of Patent: Mar. 14, 1995

[54] SINGLE-COMPONENT NON-MAGNETIC TONER DEVELOPER FOR ELECTROPHOTOGRAPHIC PROCESSES

[75] Inventors: Hun-Yi Tong, Miao Li Hsien; Yeong-Sheng Lin, Hsin-Chu Hsien, both of Taiwan, Prov. of China

[73] Assignee: Industrial Technology Research Institute, Hsinchu, Taiwan, Prov. of China

[21] Appl. No.: 90,510

[22] Filed: Jul. 13, 1993

[51] Int. Cl.[6] ..... G03G 9/087

[52] U.S. Cl. ..... 430/109; 430/903

[58] Field of Search ..... 430/903, 109, 110, 106

[56] References Cited

U.S. PATENT DOCUMENTS 5,063,133 11/1991 Kubo ..... 430/122
5,250,382 10/1993 Shimojo et al. ..... 430/109
5,270,143 12/1993 Tomiyama et al. ..... 430/109

FOREIGN PATENT DOCUMENTS 0438245 7/1991 European Pat. Off. .

*Primary Examiner*—John Goodrow
*Attorney, Agent, or Firm*—W. Wayne Liauh

[57] ABSTRACT

A non-magnetic one-component toner developer for use in electrophotographic processes having a particle size distribution represented by the following expressions: $d_1/d_{50}=0.32\sim0.55$; $d_{50}/d_{90}=0.50\sim0.70$; and $d_{50}=5\text{-}15\mu$, wherein $d_1$, $d_{50}$, and $d_{90}$ represent diameters of toner particles when the percentiles by volume or by weight of toner developer of that diameter are 1%, 50%, and 90%, respectively. The non-magnetic one-component toner developer disclosed in the present invention has a triboelectricity greater than 1.5 $\mu$C/g, a bulk specific gravity than 0.36, and a compression ratio less than 0.24, and exhibits excellent triboelectrification characteristics and flowability, as well as provides uniformly clear images without foggy background.

6 Claims, 1 Drawing Sheet

SINGLE-COMPONENT NON-MAGNETIC TONER DEVELOPER FOR ELECTROPHOTOGRAPHIC PROCESSES

FIELD OF THE INVENTION

This invention relates to a single-component, or the so-called one-component, toner developer for electrophotographic processes. More particularly, this invention relates to a non-magnetic single-component, or the so-called one-component, toner developer for use in laser printers or copiers which exhibits excellent triboelectrification characteristics and flowability, and provides uniformly clear images without foggy background.

BACKGROUND OF THE INVENTION

An electrophotographic process typically comprises six main steps: charging, photocharging, imaging, image transfer, development, and cleaning. Toner developers are used in the image transfer step to transform electrostatic latent images into positive images, which are then transferred onto papers or transparent films to produce printed copies. With a binary- or two-component developing system, the toner developer contains toner particles and carrier particles. The toner particles are first electrostatically charged through triboelectrification with the carrier particles, so that the charged toner particles can be subsequently electrostatically attracted to an electrostatic latent image on a photoconductor. Electrophotographic processes using two-component toners have been widely used in electronic facsimile devices, mainly because of their excellent image resolution, and their high electric resistance which allows the image forming process relatively unaffected by humidity and other environmental variables.

Two-component toner systems, however, have exhibit several disadvantages in that they involve relatively complicated machine construction and are difficult to maintain. Furthermore, since a toner in a two-component toner system is triboelectrically charged by mutual friction between the toner and the carrier, the surface of the carrier will be contaminated with the toner after the two-component toner is used for a certain period of time. When this occurs, the surface of the carrier will be contaminated with a very thin layer of minute toner particles, thus making it difficult or even impossible to apply sufficient triboelectric charge to the toner.

In recent years, various electrophotographic processes utilizing a magnetic one-component toner developer have been developed. A one-component toner developer contains only the toner component and is free of any carrier. A magnetic one-component toner developer typically contains 30–60 wt % magnetic powders. U.S. Pat. Nos. 3,909,258 and 4,121,931 provide disclosures of such magnetic one-component toner developers, and the contents thereof are incorporated herein by reference. An electrophotographic process utilizing one-component toner developer has the advantages in that it involves a much simplified equipment construction, and is much easier to maintain. However, the magnetic one-component developers also have several disadvantages, for example: (1) because they contain large amounts (30–60 wt %) of magnetic powders, the electrical resistance thereof is substantially reduced, thus resulting in inferior resolution and susceptibility to environmental changes; (2) the large amounts of magnetic powders contained therein also adversely affect the thermal fixing ability of the resultant toner developers; and (3) because magnetic powders are mainly comprised of black colored $Fe_3O_4$ filler material, this makes it essentially impossible to obtain non-black color toner developers.

In more recent years, electrophotographic processes utilizing non-magnetic one-component toner developer have also been developed. The non-magnetic one-component toner developer systems have a promising potential to provide all the advantages of the magnetic one-component toner developer systems, yet avoiding most if not all the of disadvantages thereof. However, it still remains a great challenge to develop a suitable non-magnetic one-component toner developer that fulfills it potential. First of all, a non-magnetic one-component toner developer must possess rapid triboelectrification characteristics as well as an ability to carry sufficient triboelectric charge, so as to allow the same to be adequately charged triboelectrically in order to form an image on a photoconductor during the very short duration of its frictional contact with a doctor blade or a conveyer roller.

Because of its inadequate triboelectric charging characteristics, a toner designed for a conventional two-component toner developer cannot be used in a one-component toner electrophotographic imaging process. However, in a two-component toner developer system this shortcoming is overcome by the additional blending and friction between the toner and the carrier to achieve adequate triboelectrification.

FIG. 1 is a simple illustrative diagram describing an electrophotographic device utilizing a non-magnetic one-component toner developer. Toner 2, which is stored in a toner storage tank 1, is carried by a spongy shaft carrier 3 to a developer sleeve 4. A doctor blade 5 controls the thickness of the toner on the developer sleeve. The frictional contact between the doctor blade 5 and the developer sleeve 4 causes the toner to become triboelectrically charged. The charged toner then is moved from the developer sleeve onto the electrostatic image on the photoconductor 6.

It has been recognized that, in order to ensure excellent printing quality using a non-magnetic one-component toner developer, it is very important to design and control the particle size of the toner developer and the distribution thereof. The particle size distribution of toners directly affects the their triboelectrification characteristics and flowability. If the toner has a particle size distribution that is too broad, it will not be able to provide good printing quality, as the broadly distributed toner particles are likely to contain excessive amounts of very large and/or very small particles. Both could adversely affect the triboelectrification characteristics and flowability of the toner composition. Very large particles not only cause the triboelectrification characteristics of the toners to be lowered, they also directly cause a deterioration of the resolution of the printed copies. Some of the problems observed from using toners that contain excessive amounts of larger particles include: protruded characters in the printed documents; blocky graphics which are rough and non-smooth; decreased shininess in the prints; increased toner consumption; etc.

If, however, the toner composition contains excessive amounts of very small particles, not only that the flowability of the toner will be impaired, thus causing non-uniform printing quality, the triboelectrification characteristics of the toner will also be adversely affected. The latter causes the problems of reduction in the print toner concentration, formation of ghost or fog background, deterioration in thermal fixability, as well as contamination of the copier or printer components. The main reason for these problems is that, due to their similarity in composition with the majority of the toner developer, these fine particles will possess excessively high triboelectricity, thus bringing in a competition with the main components of the toners during the image developing process. This results in a deterioration in the print quality. Furthermore, because of their excessively large surface area per unit weight, the fine particles will adversely affect the thermal fixing process, thus causing the printed characters or graphics to be easily peeled off. On the other hand, the fine particles, which are formed during the fine grinding step, often exhibit relatively non-uniform properties compared to the majority of the toner particles. This aberration causes some of these fine particles to be reversely charged or even carrying very low charges. The constitutes the main reason for the occurrence of ghost background.

From the above described considerations, it is hence extremely important to design and control the size distribution of the toner particles, in order to ensure consistent printing and/or copying qualities, i.e., a uniformly clear image in the solid region and no fog or ghost in the background region.

U.S. Pat. No. 5,063,133, issued to T. Kubo, et al., discloses a toner developer for electrophotographic process which satisfies the expression: $d_{75}/d_{25} \leqq d_{50}/40+1.2$, wherein $d_{25}$, $d_{50}$, and $d_{75}$ represent diameters of toner particles when the percentiles by volume or by weight or toner developer of that diameter are 25%, 50%, and 75%, respectively. The primary object of the '133 patent was to provide uniformly clear images without the fog or ghost background. However, the criterion disclosed in the '133 patent appears to be grossly inadequate, as illustrated below by results from tests conducted by the inventors. Many toner developers fit the criterion of the '133 patent but do not provide good printing quality. On the other hand, many toner developers that do not fit the criterion of the '133 patent actually provide excellent printing qualities. Therefore, a different but more rigorous as well as more accurate definition is necessary in order to design and control the optimum particle size distribution of toner developers.

In addition to the particle size distribution, other factors can be equally important in ensuring a good quality of the printed products. These factors include triboelectrification characteristics and flowability of the toner developer. European Pat. App. No. 0 438 245 A2 discloses a non-magnetic one-component toner developer comprising colored fine particles and inorganic powders, such as silicon dioxide, which have been surface-treated with a silicone oil, a silane coupling agent or a silazane compound, to impart hydrophobicity. The blending of the hydrophobically treated fine powders with the toner developer improves the triboelectrification characteristics and flowability of the final toner composition. One of the disadvantages of the toner developers disclosed in the '245 prior art is that the silicon dioxide particles, which exhibit the characteristics of primary particles before the hydrophobicity-imparting surface treatment, are likely to form primary aggregates or even bulk aggregates after the treatment, regardless of whether the treatment is done using a spraying method or a solution soaking method. The formation of the aggregates prevents the toner/silicon oxide composition from being effectively blended, and greatly undermines the benefits that were originally designed to improve the triboelectrification characteristics and flowability thereof.

SUMMARY OF THE INVENTION

The primary object of the present invention is to develop a non-magnetic one-component toner developer for use in electrophotographic processes which overcomes many of the above-mentioned disadvantages of prior art toner developers. More particularly, the primary object of the present invention is to develop a non-magnetic one-component toner developer with an appropriate particle size distribution, which can be rigorously and accurately described by a set of mathematical expressions and controlled, to thereby ensure consistently good printing/copying qualities when used in electrophotographic processes.

Another object of the present invention is to develop a non-magnetic one-component toner developer for use in electrophotographic processes which exhibits excellent triboelectrification characteristics and excellent particle flowability thus allowing excellent print/copying quality to be obtained. The copies or prints obtained from the electrophotographic process utilizing the non-magnetic one-component toner developer disclosed in the present invention exhibit uniformly clear resolution, and are free from many undesired poor print/copy qualities such as blurred edges, hollow defects, or ghost background.

To achieve the objects described hereinabove, the present invention discloses a non-magnetic one-component toner developer whose particle size is described by the following expressions: $d_1/d_{50}=0.32\sim0.55$; $d_{50}/d_{90}=0.50\sim0.70$; and $d_{50}=5\text{–}15$ μm, wherein $d_1$, $d_{50}$, and $d_{90}$ represent diameters of toner particles when the percentiles by volume or by weight of toner developer of that diameter are 1%, 50%, and 90%, respectively.

The non-magnetic one-component toner developer disclosed in the present invention exhibits excellent triboelectrification characteristics and excellent particle flowability. The triboelectric charge measured from the toner developer of the present invention exceeds 15 μC/g (microcoulomb per gram), measured using a triboelectrometer. The flowability of the toner developer of the present invention is measured using a powder tester; the results show a bulk specific gravity greater than 0.36, and a compression ratio less than 0.24.

DETAILED DESCRIPTION OF PREFERRED EMBODIMENTS

Figure 1:
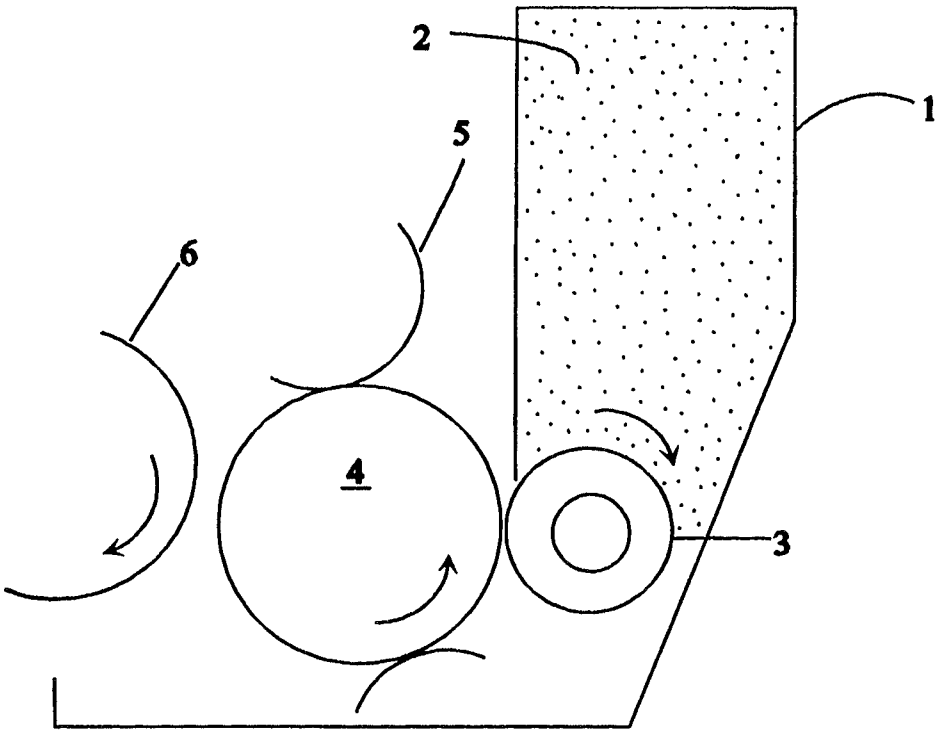
FIG. 1 is a simple illustrative diagram describing an electrophotographic device utilizing a non-magnetic one-component toner developer.

In the present invention, the particle size and particle size distribution of the toner developers were measured using an ANALYSETT 22 PARTICLE SIZER, manufactured by FRITSCH, in Germany. All the toner developers of the present invention meet the following set of expressions: $d_1/d_{50}=0.32\sim0.55$; $d_{50}/d_{90}=0.50\sim0.70$; and $d_{50}=5\text{–}15$ μm, wherein $d_1$, $d_{50}$, and $d_{90}$ represent diameters of toner particles when the percentiles by volume or by weight of toner developer of that diameter are 1%, 50%, and 90%, respectively. It has been observed by the inventors that if a toner developer has a $d_1/d_{50}<0.32$ or $d_{50}/d_{90}<0.50$, it considered to have an improper particle size distribution, i.e., they have either an excessively large number of very fine particles or an excessively large number of very large particles, or both. This often results in poor printing/copying qualities. On the other hand, if $d_1/d_{50}>0.55$ or if $d_{50}/d_{90}>0.70$, the production yield of toners would decrease substantially, thus resulting in increased production cost and rendering the production process uneconomic.

Triboelectrification characteristics of the toner developers of the invention were measured using a q/m-meter type triboelectrometer manufactured by Dr. R. H. Epping PES-Laboratorium in Germany. Precisely one g of toner developer and 19 g of carrier (TEFV 100/200, from Powdertee K. K., Japan) were added to a 80-ml PE pot. The mixture was uniformly mixed using a ball mill at a constant rotational speed of 200 rpm for 15 minutes to prepare a test sample. 1.0~1.1 g of the test sample was precisely measured and blown off, using a soft blow method and under a testing condition of 3 bar air pressure and 3 liter/min air flow rate, for 90 seconds to measure triboelectricity. The triboelectricity of the toner developer should be greater than 15 μC/g. Below 15 μC/g, the toner developer will not be able to produce good quality prints and/or copies, due to inadequate triboelectrification.

Flowability of the toner developer was tested using a powder tester Model KYT-3000 Tap Denser manufactured by Seishin Enterprises Co., Ltd. Flowability tests were conducted under the conditions of 100-ml tapping cell, 5-cm spacer height, and zero feed control; and the samples were repeatedly tapped 250 times to measure bulk specific gravity and compression ratio thereof. The toner developers of the present invention exhibited a bulk specific gravity of greater than 0.36, and a compression ratio less than 0.24. It was observed that good printing/copying results cannot be obtained if the bulk specific gravity was less than 0.36, or if the compression ratio was greater than 0.24.

In the preferred embodiments of the present invention, a charge control agent can be added to the toner developer composition. A preferred charge control agent has the following formula:

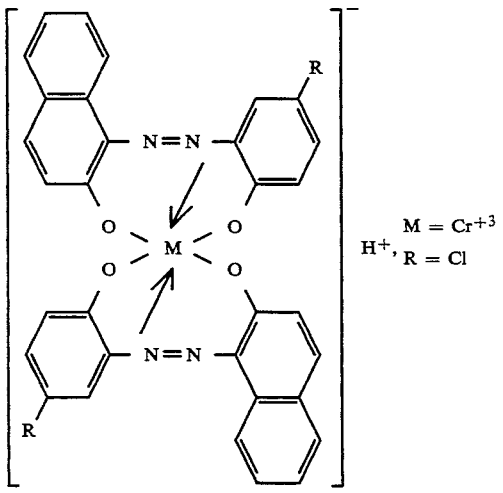

The present invention will now be described more specifically with reference to the following examples. It is to be noted that the following descriptions of examples including preferred embodiments of this invention are presented herein for purpose of illustration and description; it is not intended to be exhaustive or to limit the invention to the precise form disclosed.

Example 1

87 parts of binder resin (styrene-acrylic copolymer, ZSR-1005, manufactured by Polytribo, U.S.A.), 13 parts of carbon black (Raven 5750, from Columbia Chemical Co., U.S.A.), 2 parts of low molecular weight wax (Viscol 660p, from Sanyo Chemicals, Japan), and 3 parts of negative charge control agent (Protoner 7, from ICI, U.K.) were homogenized. Then the homogenized mixture was subject to a series of processing steps including compounding, coarsely grinding, finely grinding, and classification, to obtain 5–30 μm particles. The final product was treated with 0.2 wt % hydrophobic silicon dioxide (TS 720, from Degussa, AG, Germany) to form a non-magnetic one-component toner developer suitable for use in laser printing or xerox copying operations.

Particle size distribution, triboelectricity, and flowability of the non-magnetic one-component toner developer were measured, with the results shown in Table 1. The toner was then used in an OKI-DATA OKI-400 laser printer to produce 2,000 print copies on a continuous basis. The print results, including print toner concentration, uniformity of the prints, presence of blurred edges, print resolution, resistance to hollow defects, and background quality, were observed and reported in Table 2.

Example 2

87 parts of binder resin (styrene-acrylic copolymer, Himer TB 1000F, manufactured by Sanyo Chemicals, Japan) 13 parts of carbon black (Raven 5750, from Columbia Chemical Co., U.S.A.), 2 parts of low molecular weight wax (Viscol 660p, from Sanyo Chemicals, Japan), and 2.5 parts of negative charge control agent (Protoner 7, from ICI, U.K.) were homogenized. Then the homogenized mixture was subject to a series of processing steps including compounding, coarse grinding, fine grinding, and classification, to obtain 5–30 μm particles. The final product was treated with 0.2 wt % hydrophobic silicon dioxide (R972, from Degussa, AG, Germany) to form a non-magnetic one-component toner developer suitable for use in laser printing or xerox copying operations.

Particle size distribution, triboelectricity, and flowability of the non-magnetic one-component toner developer were measured, with the results shown in Table 1. The toner was then used in an OKI-DATA OKI-400 laser printer to produce 2,000 print copies on a continuous basis. The print results, including toner concentration, uniformity of the prints, presence of blurred edges, print resolution, resistance to hollow defects, and background quality, were observed and reported in Table 2.

Example 3

87 parts of binder resin (styrene-acrylic copolymer, Himer TB 1000F, manufactured by Sanyo Chemicals, Japan) 13 parts of carbon black (Raven 5750, from Columbia Chemical Co., U.S.A.), 2 parts of low molecular weight wax (Viscol 660p, from Sanyo Chemicals, Japan), and 3.5 parts of negative charge control agent (Protoner 7, from ICI, U.K.) were homogenized. Then the homogenized mixture was subject to a series of processing steps including compounding, coarse grinding, fine grinding, and classification, to obtain 5–30 μm particles. The final product was treated with 0.4 wt % hydrophobic silicon dioxide (R812, from Degussa, AG, Germany) to form a non-magnetic one-component toner developer suitable for use in laser printing or xerox copying operations.

Particle size distribution, triboelectricity, and flowability of the non-magnetic one-component toner developer were measured, with the results shown in Table 1. The toner was then used in an OKI-DATA OKI-400 laser printer to produce 2,000 print copies on a continuous basis. The print results, including toner concentration, uniformity of the prints, presence of blurred edges, print resolution, resistance to hollow defects, and background quality, were observed and reported in Table 2.

Comparative Example 1

87 parts of binder resin (styrene-acrylic ZSR-1005, manufactured by Polytribo, U.S.A.) 13 parts of carbon black (Raven 5750, from Columbia Chemical Co., U.S.A.), 2 parts of low molecular weight wax (Viscol 660p, from Sanyo Chemicals, Japan), and 3 parts of negative charge control agent (Protoner 7, from ICI, U.K.) were homogenized. Then the homogenized mixture was subject to a series of processing steps including compounding, coarse grinding, fine grinding, and classification, to obtain 5–30 μm particles. The final product was treated with 0.2 wt % hydrophobic silicon dioxide (TS720, from Degussa, AG, Germany) to form a non-magnetic one-component toner developer suitable for use in laser printing or xerox copying operations.

Comparative Example 2

87 parts of binder resin (styrene-acrylic copolymer, Himer TB 1000F, manufactured by Sanyo Chemicals, Japan) 13 parts of carbon black (Raven 5750, from Columbia Chemical Co., U.S.A.), 2 parts of low molecular weight wax (Viscol 660p, from Sanyo Chemicals, Japan), and 2.5 parts of negative charge control agent (Protoner 7, from ICI, U.K.) were homogenized. Then the homogenized mixture was subject to a series of processing steps including compounding, coarse grinding, fine grinding, and classification, to obtain 5–30 μm particles. The final product was treated with 0.2 wt % hydrophobic silicon dioxide (R972, from Degussa, AG, Germany) to form a non-magnetic one-component toner developer suitable for use in laser printing or xerox copying operations.

Comparative Example 3

87 parts of binder resin (styrene-acrylic ZSR-1005, manufactured by Polytribo, U.S.A.) 13 parts of carbon black (Raven 5750, from Columbia Chemical Co., U.S.A.), 2 parts of low molecular weight wax (Viscol 660p, from Sanyo Chemicals, Japan), and 1 part of negative charge control agent (Kayacharge N-3, from Nippon Pharmachemicals, Japan) were homogenized. Then the homogenized mixture was subject to a series of processing steps including compounding, coarse grinding, fine grinding, and classification, to obtain 5–30 μm particles. The final product was treated with 0.2 wt % hydrophobic silicon dioxide (TS720, from Degussa, AG, Germany) to form a non-magnetic one-component toner developer suitable for use in laser printing or xerox copying operations.

Comparative Example 4

87 parts of binder resin (styrene-acrylic ZSR-1005, manufactured by Polytribo, U.S.A.) 13 parts of carbon black (Raven 5750, from Columbia Chemical Co., U.S.A.), 2 parts of low molecular weight wax (Viscol 660p, from Sanyo Chemicals, Japan), and 1 part of negative charge control agent (Kayacharge T-3, from Nippon Pharmachemicals, Japan) were homogenized. Then the homogenized mixture was subject to a series of processing steps including compounding, coarse grinding, fine grinding, and classification, to obtain 5–30 μm particles. The final product was treated with 0.2 wt % hydrophobic silicon dioxide (TS720, from Degussa, AG, Germany) to form a non-magnetic one-component toner developer suitable for use in laser printing or xerox copying operations.

Comparative Example 5

87 parts of binder resin (styrene-acrylic ZSR-1005, manufactured by Polytribo, U.S.A.) 13 parts of carbon black (Raven 5750, from Columbia Chemical Co., U.S.A.), 2 parts of low molecular weight wax (Viscol 660p, from Sanyo Chemicals, Japan), and 3 parts of negative charge control agent (Kayacharge T-3, from Nippon Pharmachemicals, Japan) were homogenized. Then the homogenized mixture was subject to a series of processing steps including compounding, coarse grinding, fine grinding, and classification, to obtain 5–30 μm particles. The final product was treated with 0.2 wt % hydrophobic silicon dioxide (TS720, from Degussa, AG, Germany) to form a non-magnetic one-component toner developer suitable for use in laser printing or xerox copying operations.

Comparative Example 6

87 parts of binder resin (styrene-acrylic ZSR-1005, manufactured by Polytribo, U.S.A.) 13 parts of carbon black (Raven 5750, from Columbia Chemical Co., U.S.A.), 2 parts of low molecular weight wax (Viscol 660p, from Sanyo Chemicals, Japan), and 3 parts of negative charge control agent (Protoner 7, from ICI, U.K.) were homogenized. Then the homogenized mixture was subject to a series of processing steps including compounding, coarse grinding, fine grinding, and classification, to obtain 5–30 μm particles. The final product was treated with 0.05 wt % hydrophobic silicon dioxide (TS720, from Degussa, AG, Germany) to form a non-magnetic one-component toner developer suitable for use in laser printing or xerox copying operations.

Comparative Example 7

87 parts of binder resin (styrene-acrylic ZSR-1005, manufactured by Polytribo, U.S.A.), 13 parts of carbon black (Raven 5750, from Columbia Chemical Co., U.S.A.), 2 parts of low molecular weight wax (Viscol 660p, from Sanyo Chemicals, Japan), and 2.5 parts of negative charge control agent (Protoner 7, from ICI, U.K.) were homogenized. Then the homogenized mixture was subject to a series of processing steps including compounding, coarse grinding, fine grinding, and classification, to obtain 5–30 μm particles. The final product was treated with 0.05 wt % hydrophobic silicon dioxide (R972, from Degussa, AG, Germany) to form a non-magnetic one-component toner developer suitable for use in laser printing or xerox copying operations.

The particle size distribution, triboelectricity, and flowability of the non-magnetic one-component toner developers prepared in Comparative Examples 1 through 7 were measured, with the results shown in Table 1. These toners were then used in an OKI-DATA OKI-400 laser printer to produce 2,000 print copies on a continuous basis. The print results, including toner concentration, uniformity of the prints, presence of blurred edges, print resolution, resistance to hollow defects, and background quality, were observed and reported in Table 2.

Table 3 is a test of the criterion disclosed in the '133 patent, using the particle size distributions obtained from the toner developers prepared in Examples 1 through 3, and Comparative Examples 1 through 7. It is apparent that the criterion disclosed in the '133 patent fails to include the toner developers prepared in the present invention.

The foregoing description of the preferred embodiments of this invention has been presented for purposes of illustration and description. Obvious modifications or variations are possible in light of the above teaching. The embodiments were chosen and described to provide the best illustration of the principles of this invention and its practical application to thereby enable those skilled in the art to utilize the invention in various embodiments and with various modifications as are suited to the particular use contemplated. All such modifications and variations are within the scope of the present invention as determined by the appended claims when interpreted in accordance with the breadth to which they are fairly, legally, and equitably entitled.

TABLE 1

| Toner Developer | Particle Size (μ) and Distribution $d_1$ | $d_{50}$ | $d_{90}$ | $d_1/d_{50}$ | $d_{50}/d_{90}$ | Tribo-electricity (μC/g) | Flowability bulk specific gravity | compression ratio |
|---|---|---|---|---|---|---|---|---|
| Example 1 | 4.4 | 11.6 | 20.1 | 0.38 | 0.58 | −22 | 0.42 | 0.18 |
| Example 2 | 4.4 | 9.0 | 14.5 | 0.49 | 0.62 | −20 | 0.41 | 0.19 |
| Example 3 | 4.5 | 10.4 | 17.7 | 0.43 | 0.59 | −23 | 0.43 | 0.17 |
| Comp. Example 1 | 2.6 | 10.4 | 19.9 | 0.25 | 0.52 | −18 | 0.34 | 0.23 |
| Comp. Example 2 | 1.9 | 9.2 | 18.4 | 0.21 | 0.50 | −16 | 0.32 | 0.24 |
| Comp. Example 3 | 4.6 | 11.0 | 18.2 | 0.42 | 0.60 | −10 | 0.42 | 0.18 |
| Comp. Example 4 | 3.8 | 10.9 | 18.4 | 0.35 | 0.59 | −8 | 0.41 | 0.19 |
| Comp. Example 5 | 4.6 | 10.2 | 17.3 | 0.45 | 0.59 | −13 | 0.41 | 0.19 |
| Comp. Example 6 | 4.4 | 11.6 | 20.1 | 0.38 | 0.58 | −21 | 0.36 | 0.23 |
| Comp. Example 7 | 4.4 | 9.0 | 14.5 | 0.49 | 0.62 | −19 | 0.34 | 0.24 |

TABLE 2

| Toner Developer | Print Toner Concentration Solid Area | Optical Density | Uniformity of Prints | Absence of Blurred Edges and Resolution | Anti-Hollow Defects | Absence of Ghost Background |
|---|---|---|---|---|---|---|
| Example 1 | good | 1.48 | good | good | good | good |
| Example 2 | good | 1.46 | good | good | good | good |
| Example 3 | good | 1.60 | good | good | good | good |
| Comp. Example 1 | fair | 1.00 | fair | poor | poor | fair |
| Comp. Example 2 | fair | 0.89 | fair | poor | poor | fair |
| Comp. Example 3 | fair | 1.06 | poor | poor | fair | fair |
| Comp. Example 4 | poor | 0.45 | poor | poor | poor | poor |
| Comp. Example 5 | good | 1.32 | good | poor | good | good |
| Comp. Example 6 | fair | 1.29 | fair | fair | fair | fair |
| Comp. Example 7 | fair | 1.31 | fair | fair | fair | fair |

TABLE 3

| Toner Developer | Particle Size (μm) and Distribution $d_{25}$ | $d_{50}$ | $d_{75}$ | $d_{75}/d_{25} - d_{50}/40 = ?$ Result | ≦1.2 ? | Print Quality |
|---|---|---|---|---|---|---|
| Example 1 | 8.7 | 11.6 | 14.1 | 1.33 | no | good |
| Example 2 | 6.9 | 9.0 | 10.6 | 1.31 | no | good |
| Example 3 | 8.0 | 10.4 | 12.6 | 1.32 | no | good |
| Comp. Example 1 | 7.2 | 10.4 | 13.3 | 1.59 | no | poor |
| Comp. Example 2 | 6.3 | 9.2 | 12.0 | 1.67 | no | poor |
| Comp. Example 3 | 8.2 | 11.0 | 13.2 | 1.32 | no | poor |
| Comp. Example 4 | 8.1 | 10.9 | 13.1 | 1.35 | no | poor |
| Comp. Example 5 | 7.8 | 10.2 | 12.3 | 1.32 | no | poor |
| Comp. Example 6 | 8.7 | 11.6 | 14.1 | 1.33 | no | poor |
| Comp. Example 7 | 6.9 | 9.0 | 10.6 | 1.32 | no | poor |

What is claimed is:

1. A non-magnetic one-component toner developer for electrophotographic processes containing toner particles having a particle size distribution represented by the following formulas:

(a) $d_1/d_{50}=0.32\sim0.55$;

(b) $d_{50}/d_{90}=0.50\sim0.70$; and (c) $d_{50}=5\text{–}15$ μm;

(d) wherein $d_1$, $d_{50}$, and $d_{90}$ represent diameters of said toner particles when the percentiles by volume or by weight of toner developer of that diameter are 1%, 50%, and 90%, respectively.

2. The non-magnetic one-component toner developer of claim 1 which has a triboelectricity greater than 15 μC/g.

3. The non-magnetic one-component toner developer of claim 1 which has a bulk specific gravity greater than 0.36 and a compression ratio less than 0.24.

4. The non-magnetic one-component toner developer of claim 1 which comprises 87 parts of styrene-acrylic copolymeric resin binder, 13 parts carbon black, 2 parts low molecular weight wax, and 2–4 parts charge control agent.
5. The non-magnetic one-component toner developer of claim 4 which further comprises 0.1~1 wt % hydrophobic silicon dioxide coated on the surface thereof.
6. The non-magnetic one-component toner developer of claim 4 wherein said charge control agent is represented by the following formula:
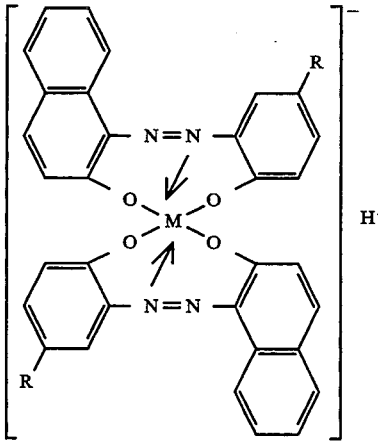
$M = Cr^{+3}$
$H^+, R = Cl$ .
* * * * *